US005121433A

United States Patent [19]

Kendall et al.

[11] Patent Number: 5,121,433

[45] Date of Patent: Jun. 9, 1992

[54] APPARATUS AND METHOD FOR CONTROLLING THE MAGNITUDE SPECTRUM OF ACOUSTICALLY COMBINED SIGNALS

[75] Inventors: Gary S. Kendall, Evanston; Martin D. Wilde, Chicago; William L. Martens, Evanston, all of Ill.

[73] Assignee: Auris Corp., Evanston, Ill.

[21] Appl. No.: 538,547

[22] Filed: Jun. 15, 1990

[51] Int. Cl.[5] ..... H04S 1/00

[52] U.S. Cl. ..... 381/1; 351/17; 351/97

[58] Field of Search ..... 381/1, 17, 97

[56] References Cited

U.S. PATENT DOCUMENTS 4,868,878 9/1989 Kunugi et al. ..... 381/1
4,972,489 11/1990 Oki et al. ..... 381/97

FOREIGN PATENT DOCUMENTS 0142900 6/1986 Japan ..... 381/97
0204898 8/1988 Japan ..... 381/1

*Primary Examiner*—Forester W. Isen
*Attorney, Agent, or Firm*—McCubbrey, Bratels, Meyer & Ward

[57] ABSTRACT

An apparatus and method for providing a sound field to an auditorium or the like is disclosed. The preferred embodiment of the apparatus utilizes random phase shifts to counter the effects of interference between sound patterns generated by different loudspeakers in a multi-loudspeaker sound reproduction system.

14 Claims, 2 Drawing Sheets

APPARATUS AND METHOD FOR CONTROLLING THE MAGNITUDE SPECTRUM OF ACOUSTICALLY COMBINED SIGNALS

BACKGROUND OF THE INVENTION

The present invention relates to the field of acoustic reproduction and, more particularly, to the reproduction of sound by multiple speakers having overlapping sound fields.

The process of filling a large area with sound, is usually performed by feeding the audio material to multiple speakers placed throughout the area. This technique creates certain problems, the foremost being the interference patterns that are produced when sound waves emanating from different speakers converge. Consider two speakers transmitting the same signal. At any given location relative to the two speakers, there will be certain frequencies for which constructive interference occurs, i.e., for which the sound waves reinforce each other; and there will be other frequencies for which the interference is destructive. The particular frequencies at which these different interference patterns occur are determined by the distance from each of the speakers to the location in question. The effect is also observed when loudspeakers are arranged vertically. Hence, the sound field at every point in the room will appear to be filtered by a set of frequency filters whose pass-band frequencies depend on the location relative to the speakers. In other words, listeners in different areas of the room will hear different sounds, none of which being identical to the sounds being played through the speakers.

Broadly, it is an object of the present invention to provide an improved system and method for sound reproduction.

It is another object of the present invention to provide a sound reproduction system which avoids the perception of constructive and destructive interference of sounds emanating from different loudspeakers having overlapping sound fields.

These and other objects of the present invention will become apparent to those skilled in the art from the following detailed description of the invention and the accompanying drawings.

SUMMARY OF THE INVENTION

The present invention comprises a method and apparatus for providing an improved sound reproduction system capable of filling a large area with a broad, flat, unbroken sound field. The system of the present invention utilizes an apparatus which controls the cross-correlation measure of a plurality of output signals generated from a single monophonic input signal. These processed signals are then fed to a plurality of speakers placed throughout the area in question.

This system permits similar material to be played through multiple speakers without the constructive and destructive interference patterns that normally result from the overlapping of sound waves emanating from different speakers. The system provides an apparent broadening of the sound field, yet does not exhibit the slow variation in phase shift with frequency that would cause the sound field to appear to be broken. The timbral quality or color of the resultant sound is not significantly altered from that of the input signal, independent of the program material.

DETAILED DESCRIPTION OF THE INVENTION

Figure 1:
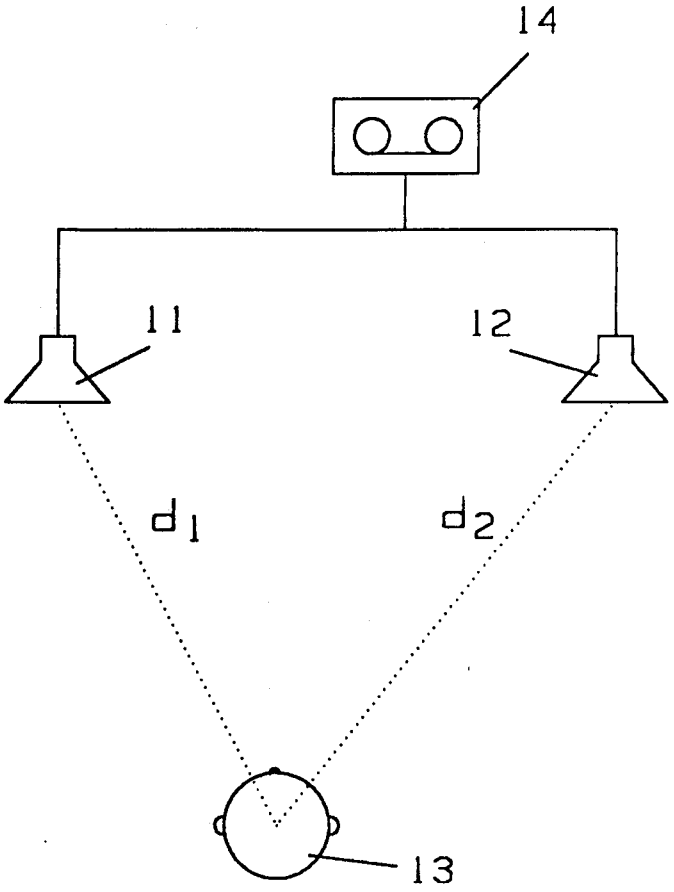
FIGURE 1 (PRIOR ART)
FIG. 1 is a diagram of a prior art sound system for providing a constant magnitude sound field.

The present invention comprises a method and apparatus for providing an improved sound reproduction system capable of filling a large area with a broad, flat, unbroken sound field. The system utilizes an apparatus which generates a plurality of output signals from a single input signal. The manner in which the present invention operates may be most easily understood by considering a system having only two output signals. Such a system is illustrated in FIG. 1. Audio source material from source 14 is played through speakers 11 and 12. A listener 13 is positioned a distance $d_1$ from speaker 11 and $d_2$ from speaker 12.

The goal of the system shown in FIG. 1 is to provide a sound field having constant magnitude independent of the location of listener 13. Ideally, listener 13 should perceive a sound field which is substantially the same as said listener would perceive if he or she were directly in front of speaker 11 and speaker 12 was turned off.

Consider the case in which a single tone of frequency w is played through each speaker. Assume that the sound leaving the speakers is in phase. The sound field at listener 13 will be the sum of two sound fields and have an intensity I(w) at angular frequency w which is given by $$I(w)=a_1^2+a_2^2+2a_1a_2\cos(w\delta D/v) \quad (1)$$

Here, $a_1$ and $a_2$ are the amplitude at the location of listener 13 of the sound waves from the speakers 11 and 12, respectively; $\delta D$ is $d_1-d_2$, and v is the speed of sound. The angular frequency w is $2\pi f$ where f is the frequency of the tone. It is clear from Eq. (1) that even if the amplitude of the sound wave at the speakers remains constant (i.e., $a_1$ and $a_2$ are constant) as w is varied, the intensity at listener 13 will vary. Furthermore, the variation will be different for different listener locations.

It is known from psycho-acoustical research that there is a critical bandwidth below which the human ear can not discriminate sub-bands. The critical bandwidth depends on frequency, varying from approximately 100 Hz at low frequencies (<2000 Hz) to approximately one seventh the center frequency of the band in question at high frequencies (>2000 Hz).

Within a critical band, the listener perceives a signal intensity which is the average of the intensities at the various frequencies within the band. Consider a frequency band having a half-width $\delta w$ centered at a frequency $w_0$. It will be assumed that $2\delta w$ is equal to the critical bandwidth at $w_0$. Assume that a sound having a constant intensity as a function of frequency is played through the speakers. A listener will perceive a single band having a frequency w and an intensity given by $$I(w_0)=A+BC(w_0) \quad (2)$$

Here $$C(w_0)=\int \cos(z\delta D/v)dz \quad (3)$$

where the integration is carried out from $w_0-\delta w$ to $w_0+\delta w$, and A and B are constants. C(w) is the average value of cos (wδD/v) in the critical band. Since C(w) varies with w and location (i.e., δD), the sound spectrum perceived by a listener will not be constant intensity even though a signal of constant intensity is being played. And, listeners at different locations will perceive different sound spectra.

Figure 2:
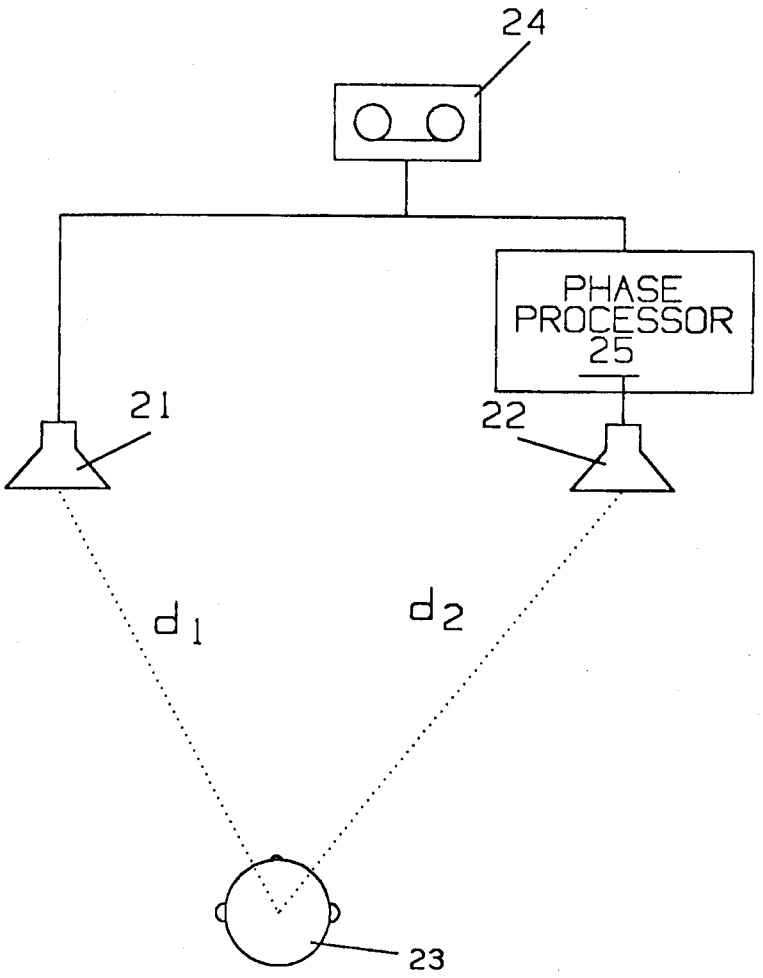
FIG. 2 is a block diagram of a system according to the present invention for providing a constant magnitude sound field.

The present invention substantially reduces the variation of I with frequency and distance by introducing a phase shift between the speakers as shown in FIG. 2. FIG. 2 depicts the a listener 23 in a sound field generated by speakers 21 and 22. The speakers are fed from a sound source 24. The signal fed to speaker 22 is phase shifted by phase processor 25 which introduces a frequency dependent phase shift into the material received by it. However, phase processor 25 does not alter the amplitude of the signals input thereto. That is, phase processor 25 produces an output signal having the same amplitude as a function of frequency as the input signal but a phase which differs from the input signal by an amount that will be denoted as p(w).

If the speakers in question differ in phase by p(w), it can be shown that the intensity in a critical band is given by $$I(w_0)=A+BC'(w_0) \quad (4)$$

Here, C'(w) is the average value of cos [wδD/v+p(w)] over the critical band centered at $w_0$. Hence, if the p(w) can be chosen such that the variation of C'(w) with w is less than that of C(w), the perceived distortion of the sound spectrum due to interference of the sound waves will be reduced. For this approach to succeed at all locations, p(w) must be chosen such that this occurs independent of the location of the listener. Hence, the goal is to find a p(w) such that the average value of cos [kw+p(w)] over a critical band centered at $w_0$ varies less as a function of $w_0$ than the average value of cos [kw] over the same band, for any non-zero constant k.

The variation cos [wδD/v+p(w)] depends on the value of [wδD/v+p(w)] modulo 2π for the various values of w in the critical band. Hence, if p(w) is a rapidly varying function with a spread in values of at least 2π, [wδD/v+p(w)] modulo 2π will tend to be a sequence of random numbers. It is well known from the statistical arts that the variance of a sum of function values of a random variable tends to 0 as the number of function values in the sum increases. Hence, by selecting p(w) such that [wδD/v+p(w)] modulo 2π is randomized, the desired result can be obtained.

Figure 3:
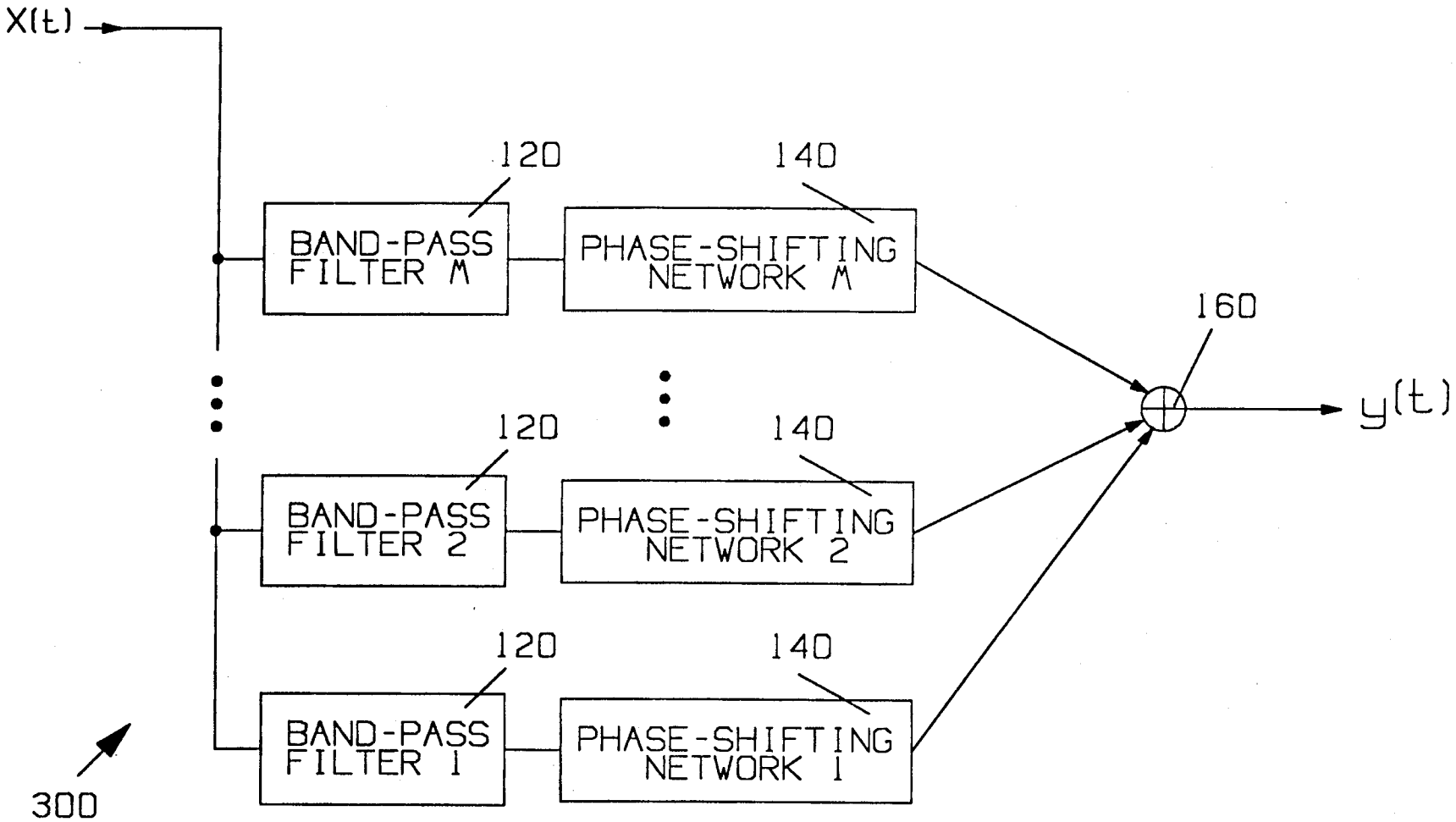
FIG. 3 is a block diagram of a phase processing circuit according to the present invention.

The preferred embodiment of the present invention provides the desired randomization by utilizing a p(w) which is a sequence random values between −π and π. However, it will be apparent to those skilled in the art that a random sequence between P and P+2π, where P is any constant, will provide identical results. A block diagram of a phase processor 300 according to the present invention is shown in FIG. 3. Phase processor 300 utilizes a plurality of bandpass filters 120 to divide an input signal x(t) into M frequency bands. The ith said frequency comprises the frequencies between $f_i-\delta f_i$ and $f_i+\delta f_i$. The signal in the ith frequency band is then phase-shifted by an amount $p_i$ utilizing a phase-shifting network 140. The M phase-shifted signals are then summed by signal adder 160 to form the output signal y(t). The M phase shift values are selected at random between −π and π.

If more than two speakers are used to play the material, a phase processor according to the present invention may be placed between the sound source and each speaker. In this case, the phase shifts added by each phase processor must be different random sequences. It will be apparent to those skilled in the art that the phase processor may be omitted from one speaker as was the case shown in FIG. 2.

Although the preferred embodiment of the present invention utilizes random phase shifts, it will be apparent to those skilled in the art that any set of phase shifts for which the average value of cos [wδD/v+p(w)] over each critical band is substantially independent of w and δD will also function satisfactorily. Any rapidly changing function of w having values between −π and π will reduce the dependence of the average value of cos [wδD/v+p(w)] on w and δD.

The optimum size of the bands into which the input signal is broken prior to phase shifting each band depends on two factors. As the number of sub-bands in any given critical band increases, the variation in the average value of cos [wδD/v+p(w)] with frequency or δD decrease. Hence, smaller bands are preferred; however, there is a lower limit to the size of the bands. As will be discussed in more detail below, the minimum bandwidth is of the order of 50 Hz.

The above described embodiments of the present invention utilize bandpass filters and phase-shift circuits. The same results may be obtained, however, by convolving x(t) with a filter function h(t) to produce y(t). That is:

$$y(t)=\int x(t-z)h(z)dz \quad (5)$$

The transformation function h(z) provides a phase-shifting of the individual frequency bands.

The present invention preferably utilizes a digital input signal. If the signal source consists of an analog signal, it may be converted to digital form via a conventional analog-to-digital converter. In this case, each output signal consists of a sequence of digital values. The ith value for each output signal corresponds to the value of the output signal at time iT, where T is the time between digital samples. In this case, the convolution operation given in Eq. (5) reduces to:

$$y(nT)=y_n=\Sigma_m x_{n-m}h_m \quad (6)$$

where m runs from 0 to N−1. The filter coefficients, $h_m$ are calculated from:

$$h_m=(1/N)\Sigma_k \exp(kmw+p_k) \quad (7)$$

Here, k runs from 0 to N−1, $w=2*\pi/N$, $\exp(\alpha)=e^{j\alpha}$, and N is the total number of frequency samples.

The number of frequency samples N directly specified in the frequency domain and used to create the incoherent time domain signal is limited by the number of points comprising the time domain signal. Typically, these points are linearly spaced across frequency. The filter coefficients that result from using the Fast Fourier Transform given in Eq. (7) will not be constant between the specified frequency points. As a result, timbral neutrality will be completely accomplished only if N is very large in the above described equations. There is a practical limit to the size of N in commercially realizable apparatuses.

In addition, for complete timbral neutrality, the integral given in Eq. (5) must be performed from $-\infty$ to $+\infty$. However, in practice, the maximum acceptable convolution time is of the order of 20 msec. If longer times are chosen, transient properties of the input signal are smeared in time. Hence, for any given sampling rate, there is a trade-off between timbral neutrality and the effect at low frequencies. As a result, the bandwidth utilized in the preferred embodiment of the present invention is greater than or equal to 50 Hz.

As noted above, the present invention minimizes the effects of this tradeoff by providing the unprocessed signal as one of the output channels. In addition, these effects can be further minimized by the particular random number sequence used in generating the phase shifts. It has been found experimentally that different sets of phase shifts, $p_k$, produce different subjective effects on the listener. Hence, in the preferred embodiment of the present invention, a number of different sets of phase shifts are generated, and the set producing the best effect, as judged by listening to the output signals, is utilized.

There has been described herein a novel apparatus and method for converting a monophonic signal into a plurality of output signals in which the cross-correlation measure of any pair of output signals is essentially zero. Various modifications of the present invention will become apparent to those skilled in the art from the foregoing description and accompanying drawings. Accordingly, the present invention is to be limited solely by the scope of the following claims.

What is claimed is:

1. An apparatus for providing program material comprising an electrical signal to first and second loudspeakers, said apparatus comprising:

means for converting said electrical signal to a first phase processed electrical signal having a phase as a function of frequency which differs from that of said electrical signal by an amount equal to p(w) at angular frequency w, the intensity of said phase processed signal as a function of w being substantially the same as that of said electrical signal; and means for playing said first phase processed electrical signal through said first loudspeaker, wherein p(w) is chosen such that the average value of cos {kw+p(w)} over a frequency band of width equal to a critical bandwidth at $w_0$ varies less as a function of $w_0$ than the average value of cos (kw) over the same frequency band, for all non-zero values of k.

2. The apparatus of claim 1 further comprising means for playing said electrical signal through said second loudspeaker.

3. The apparatus of claim 1 further comprising means for converting said electrical signal to a second phase processed electrical signal having a phase as a function of frequency which differs from that of said first phase processed signal by an amount equal to p(w) at angular frequency w, the intensity of said phase processed signal as a function of w being substantially the same as that of said electrical signal, wherein p(w) is chosen such that the average value of cos [kw+p(w)] over a frequency band of width equal to a critical bandwidth at $w_0$ varies less as a function of $w_0$ than the average value of cos [kw] over the same frequency band wherein k is any non-zero constant; and means for playing said second phase processed electrical signal through said second loudspeaker.

4. The apparatus of claim 1 wherein said converting means comprises means for shifting the phase of said electrical signal in each of M frequency bands, the ith said frequency band comprising the frequencies between $f_i-\delta f_i$ and $f_i+\delta f_i$ and being shifted by an amount $p_i$.

5. The apparatus of claim 4 wherein said $p_i$ are a random sequence of values between P and $P+2\pi$ where P is a constant.

6. The apparatus of claim 4 wherein said $\delta f_i$ is greater than 25 Hz for at least one value of i.

7. The apparatus of claim 1 wherein said converting means comprises means for convolving said electrical signal with a filter function.

8. A method for providing program material comprising an electrical signal to first and second loudspeakers, said method comprising the steps of:

converting said electrical signal to a first phase processed electrical signal having a phase as a function of frequency which differs from that of said electrical signal by an amount equal to p(w) at angular frequency w, the intensity of said phase processed signal as a function of w being substantially the same as that of said electrical signal; and playing said first phase processed electrical signal through said first loudspeaker, wherein p(w) is chosen such that the average value of cos {kw+p(w)} over a frequency band of width equal to a critical bandwidth at $w_0$ varies less as a function of $w_0$ than the average value of cos (kw) over the same frequency band, for all non-zero values of k.

9. The method of claim 8 further comprising the step of playing said electrical signal through said second loudspeaker.

10. The method of claim 8 further comprising the steps of:

converting said electrical signal to a second phase processed electrical signal having a phase as a function of frequency which differs from that of said first phase processed signal by an amount equal to p(w) at angular frequency w, the intensity of said phase processed signal as a function of w being substantially the same as that of said electrical signal, wherein p(w) is chosen such that the average value of cos [kw+p(w)] over a frequency band of width equal to a critical bandwidth at $w_0$ varies less as a function of $w_0$ than the average value of cos [kw] over the same frequency band wherein k is any non-zero constant; and playing said second phase processed electrical signal through said second loudspeaker.

11. The method of claim 8 wherein said converting step comprises shifting the phase of said electrical signal in each of M frequency bands, the ith said frequency band comprising the frequencies between $f_i-\delta f_i$ and $f_i+\delta f_i$, by an amount $p_i$.

12. The method of claim 11 wherein said $p_i$ comprise a random sequence of values between P and $P+2\pi$ where P is a constant.

13. The method of claim 11 wherein said $\delta f_i$ is greater than 25 Hz for at least one value of i.

14. The method of claim 8 wherein said converting step comprises convolving said electrical signal with a filter function.

* * * * *